US010858962B2

(12) United States Patent
Voges

(10) Patent No.: US 10,858,962 B2
(45) Date of Patent: Dec. 8, 2020

(54) LINEAR-GUIDED VALVE BRIDGE FOR AN INTERNAL COMBUSTION ENGINE

(71) Applicant: Harley-Davidson Motor Company Group, LLC, Milwaukee, WI (US)

(72) Inventor: Johann Voges, Brookfield, WI (US)

(73) Assignee: HARLEY-DAVIDSON MOTOR COMPANY GROUP, LLC, Milwaukee, WI (US)

( * ) Notice: Subject to any disclaimer, the term of this patent is extended or adjusted under 35 U.S.C. 154(b) by 118 days.

(21) Appl. No.: 16/280,508

(22) Filed: Feb. 20, 2019

(65) Prior Publication Data

US 2019/0257218 A1 Aug. 22, 2019

Related U.S. Application Data

(60) Provisional application No. 62/633,259, filed on Feb. 21, 2018.

(51) Int. Cl.

| | |
|---|---|
| ***F01L 1/14*** | (2006.01) |
| ***F01L 1/18*** | (2006.01) |
| ***F01M 9/10*** | (2006.01) |

(52) U.S. Cl.

CPC ..... *F01L 1/14* (2013.01); *F01L 1/18* (2013.01); *F01M 9/10* (2013.01); *F01M 9/104* (2013.01)

(58) Field of Classification Search

CPC ..... F01L 1/14; F01L 1/18; F01L 1/181; F01L 1/24; F01L 1/26; F01L 9/023; F01M 9/10; F01M 9/104

USPC ..... 123/90.33, 90.42, 90.5, 90.12, 90.39, 123/90.16, 90.4, 90.22, 90.23

See application file for complete search history.

(56) References Cited

U.S. PATENT DOCUMENTS

| | | | | |
|---|---|---|---|---|
| 3,963,004 A * | 6/1976 | Lysinger | F01L 1/181 | 123/90.4 |
| 5,501,187 A * | 3/1996 | Speil | F01L 1/143 | 123/90.22 |
| 5,626,110 A * | 5/1997 | Regueiro | F01L 1/185 | 123/90.22 |
| 5,682,849 A * | 11/1997 | Regueiro | F01L 1/143 | 123/90.22 |
| 7,905,208 B2 | 3/2011 | Ruggiero et al. | | |

(Continued)

FOREIGN PATENT DOCUMENTS

EP 1477638 A1 11/2004

*Primary Examiner* — Devon C Kramer
*Assistant Examiner* — Kelsey L Stanek
(74) *Attorney, Agent, or Firm* — Michael Best & Friedrich LLP

(57) ABSTRACT

A cylinder head assembly is for an internal combustion engine. The cylinder head assembly includes a cylinder head and first and second valves coupled to the cylinder head. The first and second valves are associated with a combustion chamber partially defined by the cylinder head. The cylinder head assembly also includes a fixed member coupled to the cylinder head and a valve bridge engageable with the first and second valves. The valve bridge is axially moveable along an axis relative to the fixed member to move the first and second valves together between an open position and a closed position. The cylinder head assembly further includes an anti-rotation feature between the valve bridge and the fixed member. The anti-rotation feature restricts rotational movement of the valve bridge about the axis.

20 Claims, 12 Drawing Sheets

(56) References Cited

U.S. PATENT DOCUMENTS

| | | | | |
|---|---|---|---|---|
| 8,146,566 | B2 | 4/2012 | Lee et al. | |
| 8,210,144 | B2 | 7/2012 | Langewisch | |
| 8,434,451 | B2 | 5/2013 | Yoon et al. | |
| 8,578,901 | B2 | 11/2013 | Ruggiero et al. | |
| 8,936,006 | B2 | 1/2015 | Groth et al. | |
| 9,309,788 | B2 | 4/2016 | Nair et al. | |
| 9,790,824 | B2 | 10/2017 | Baltrucki et al. | |
| 9,879,575 | B2 | 1/2018 | Erdman et al. | |
| 2003/0079705 | A1* | 5/2003 | Lutz | F01L 1/18 123/90.39 |
| 2009/0064955 | A1* | 3/2009 | Rauch | F01L 1/14 123/90.55 |
| 2014/0283774 | A1 | 9/2014 | Langewisch | |
| 2016/0369659 | A1* | 12/2016 | Junker | F01L 1/181 |
| 2017/0107871 | A1 | 4/2017 | Kim | |
| 2017/0167319 | A1 | 6/2017 | Kim et al. | |
| 2018/0080350 | A1 | 3/2018 | Nair et al. | |
| 2018/0094553 | A1 | 4/2018 | Nair et al. | |

* cited by examiner

LINEAR-GUIDED VALVE BRIDGE FOR AN INTERNAL COMBUSTION ENGINE

CROSS-REFERENCE TO RELATED APPLICATIONS

This application claims priority to U.S. Provisional Patent Application No. 62/633,259 filed on Feb. 21, 2018, the contents of which are incorporated herein by reference.

FIELD OF THE DISCLOSURE

The present disclosure relates to cylinder heads for internal combustion engines including valve bridges that connect to two similar valves for mutual actuation.

BACKGROUND

A cylinder head of an internal combustion engine includes at least one intake valve that allows intake air to enter a combustion chamber of the internal combustion engine and at least one exhaust valve that allows exhaust gases (e.g., ignited air and gasoline mixture) to exit the combustion chamber. Some cylinder heads include a valve bridge connecting to two similar valves (e.g., two intake valves or two exhaust valves) such that actuation of the valve bridge moves the two similar valves from a closed position to an open position. When open, the intake valves allow intake air to enter the combustion chamber. When the exhaust valves are opened, exhaust gases are allowed to exit the combustion chamber. When in their respective closed positions, the intake and exhaust valves block the intake air/exhaust gases from entering/exiting the combustion chamber.

SUMMARY

In one aspect, a cylinder head assembly is for an internal combustion engine. The cylinder head assembly includes a cylinder head and first and second valves coupled to the cylinder head. The first and second valves are associated with a combustion chamber partially defined by the cylinder head. The cylinder head assembly also includes a fixed member coupled to the cylinder head and a valve bridge engageable with the first and second valves. The valve bridge is axially moveable along an axis relative to the fixed member to move the first and second valves together between an open position and a closed position. The cylinder head assembly further includes an anti-rotation feature between the valve bridge and the fixed member. The anti-rotation feature restricts rotational movement of the valve bridge about the axis.

In another aspect, a cylinder head assembly is for an internal combustion engine. The cylinder head assembly includes a cylinder head and first and second valves coupled to the cylinder head. The first and second valves are associated with a combustion chamber partially defined by the cylinder head. The cylinder head assembly also includes a fixed member coupled to the cylinder head and a valve bridge having a first arm engageable with the first valve and a second arm engageable with the second valve. The valve bridge is receivable through an aperture of the fixed member from above the fixed member for the first and second arms to engage the first and second valves while the fixed member is coupled to the cylinder head.

In yet another aspect, a cylinder head assembly is for an internal combustion engine. The cylinder head assembly includes a cylinder head and first and second valves coupled to the cylinder head. The first and second valves are associated with a combustion chamber partially defined by the cylinder head. The cylinder head assembly also includes a fixed member coupled to the cylinder head. The fixed member includes a wall defining an aperture. The cylinder head assembly further includes a valve bridge having a body received within the aperture of the fixed member, a first arm engageable with the first valve, and a second arm engageable with the second valve. The body slidably engages the wall of the fixed member such that the valve bridge is moveable along an axis relative to the fixed member for the first and second arms to move the first and second valves.

In addition, other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and being practiced or being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
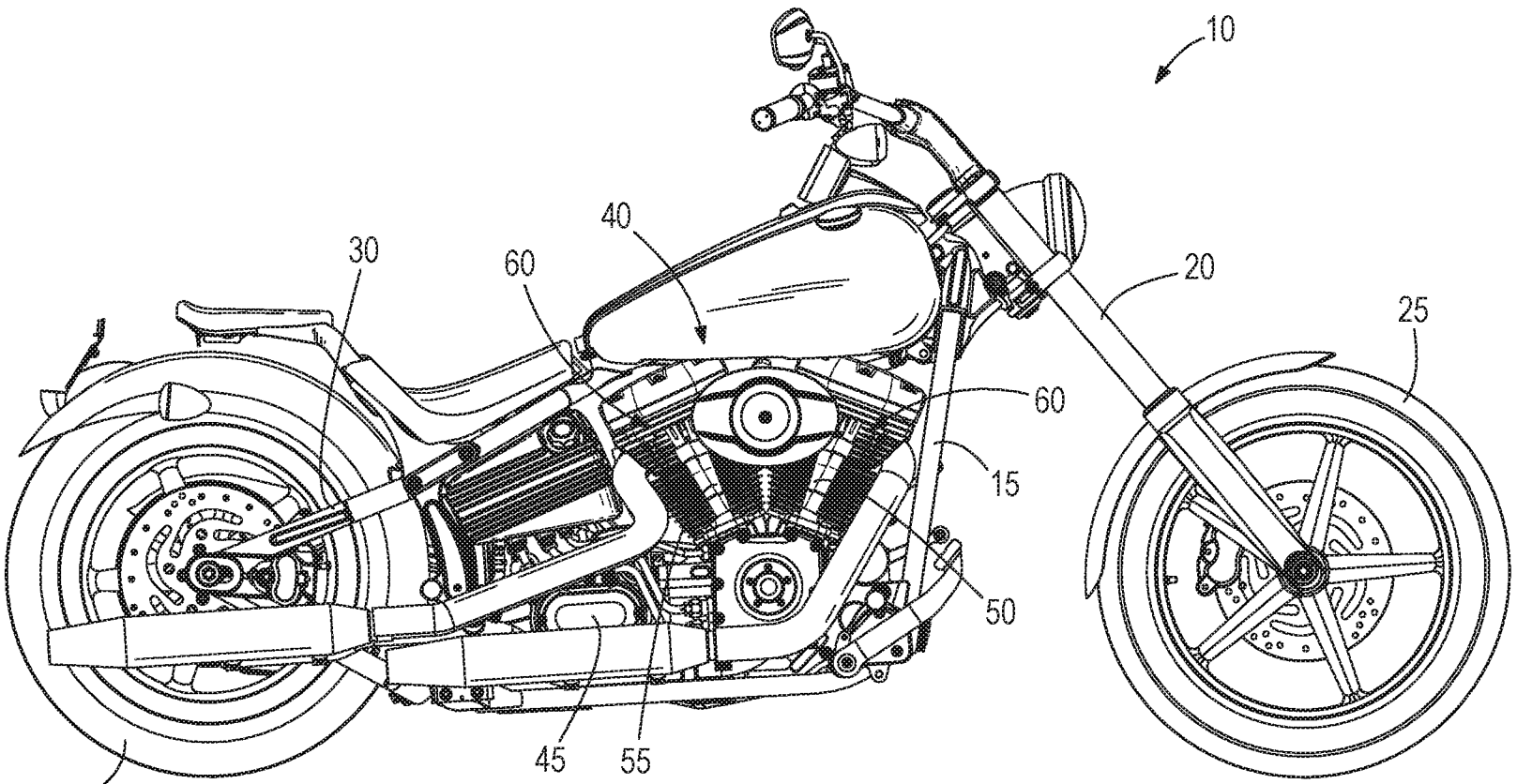
FIG. 1 is a side view of a motorcycle that includes an internal combustion engine.

FIG. 1 illustrates a motorcycle 10 including a frame 15, a front fork assembly 20 pivotably coupled to the frame 15, a front wheel 25 rotatably coupled to the front fork assembly 20, a rear swingarm 30 coupled to the frame 15, and a rear wheel 35 rotatably coupled to the rear swingarm 30. An internal combustion engine 40 (e.g., a four stroke gasoline engine) is also coupled to the frame 15 and operable to drive the rear wheel 35 via a transmission 45. The engine 40 is a V-twin engine including a first or front cylinder block 50 and a second or rear cylinder block 55 with a cylinder head assembly 60 coupled on top of each front and rear cylinder blocks 50, 55. Only one of the cylinder head assemblies 60 will be discussed in detail herein, but the disclosure of one cylinder head assembly 60 is equally applicable to the other cylinder head assembly 60.

Figure 2:
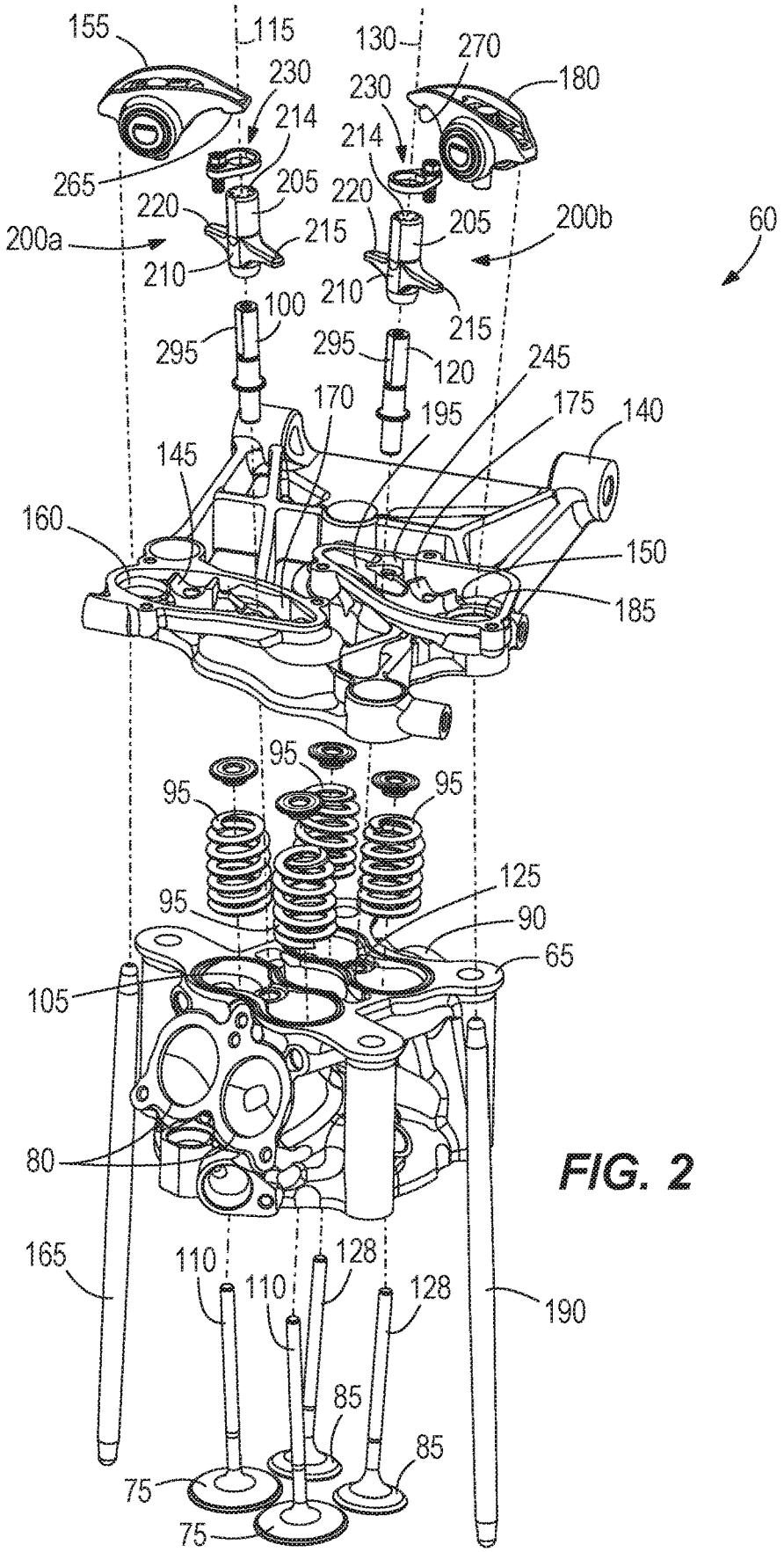
FIG. 2 is an exploded view of a cylinder head assembly of the internal combustion engine according to one embodiment.
Figure 5:
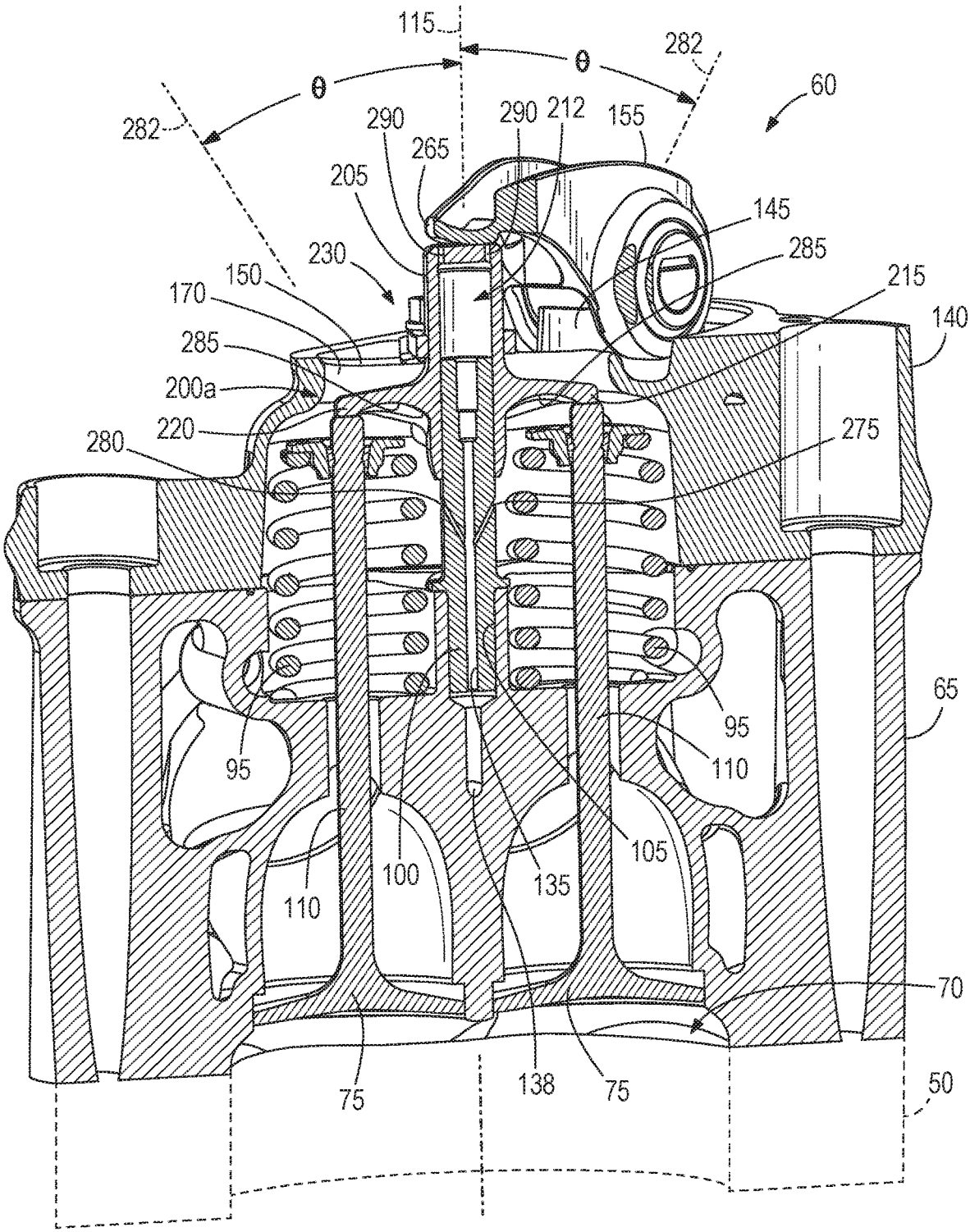
FIG. 5 is a cross sectional view of the cylinder head assembly taken along line 5-5 of FIG. 3 illustrating valves of the cylinder head assembly in a closed position.

With reference to FIG. 2, the illustrated cylinder head assembly 60 includes a cylinder head 65 that forms a combustion chamber 70 (FIG. 5) with the cylinder block 50, 55 to which it is coupled. The cylinder head 65 supports two intake valves 75 fluidly positioned between the combustion chamber 70 and at least one air intake port 80 of the cylinder head 65 (two air intake ports 80 are shown in FIG. 2) and also supports two exhaust valves 85 fluidly positioned between the combustion chamber 70 and at least one exhaust port 90 of the cylinder head 65. Each valve 75, 85 is biased into a closed position (FIG. 5 illustrates the intake valves 75 in the closed position) by a valve spring 95. In other embodiments, the cylinder head assembly 60 can include one intake valve 75, three intake valves 75, four intake valves 75, etc., and/or the cylinder head assembly 60 can include one exhaust valve 85, three exhaust valves 85, four exhaust valves 85, etc.

Figure 6:
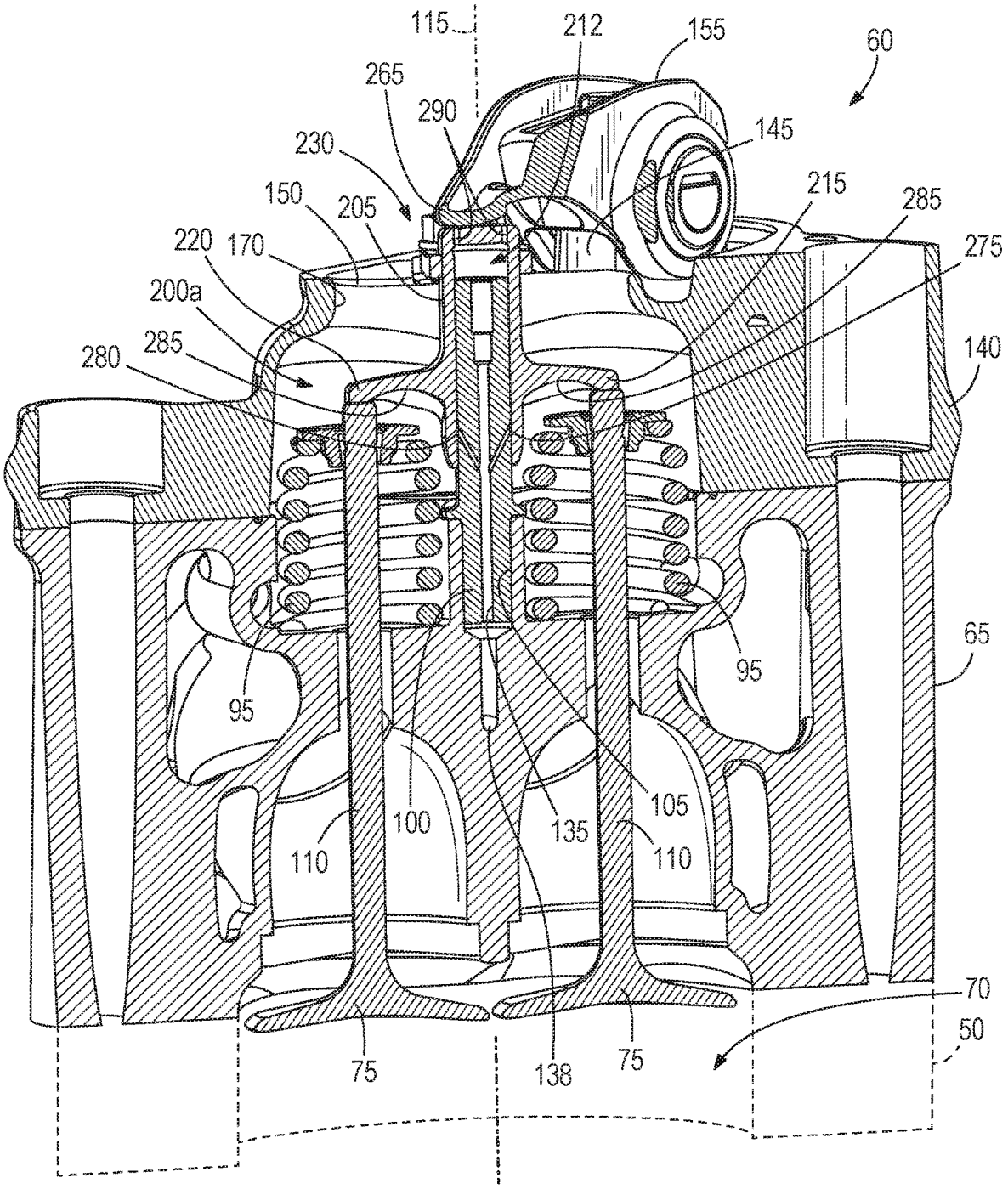
FIG. 6 is a cross sectional view of the cylinder head assembly taken along line 5-5 of FIG. 3 illustrating the valves of the cylinder head assembly in an open position.

A first fixed member (e.g., a first fixed post 100) is fixedly coupled within a first post aperture 105 of the cylinder head 65 (e.g., threadably coupled to the post aperture 105) for the first fixed post 100 to be positioned between valve stems 110 of the two intake valves 75. The first fixed post 100 includes a first longitudinal axis 115 oriented substantially parallel to a longitudinal axis of each valve stem 110 of the two intake valves 75. In other embodiments, the first longitudinal axis 115 can be obliquely oriented (e.g., about 5 degrees) relative to each longitudinal axis of the valve stems 110 to accommodate a radial combustion chamber 70. Likewise, a second fixed member (e.g., a second fixed post 120) is fixedly coupled within a second post aperture 125 of the cylinder head 65 (e.g., threadably coupled to the post aperture 125) for the second fixed post 120 to be positioned between valve stems 128 of the two exhaust valves 85. The second fixed post 120 includes a second longitudinal axis 130 oriented substantially parallel to a longitudinal axis of each valve stem 128 of the two exhaust valves 85. In other embodiments, the second longitudinal axis 130 can be obliquely oriented (e.g., about 5 degrees) relative to each longitudinal axis of the valve stems 128 to accommodate a radial combustion chamber 70. Each of the first and second fixed posts 100, 120 includes an internal passageway 135 (the passageway 135 of the first fixed post 100 is shown in FIGS. 5 and 6) in fluid communication with a lubricant supply source (not shown) via the respective first and second post apertures 105, 125. In the illustrated embodiment, the lubricant supply source is an oil supply source of the engine 40, and the cylinder head 65 includes an oil gallery 138 that supplies oil to the passageway 135.

Figure 3:
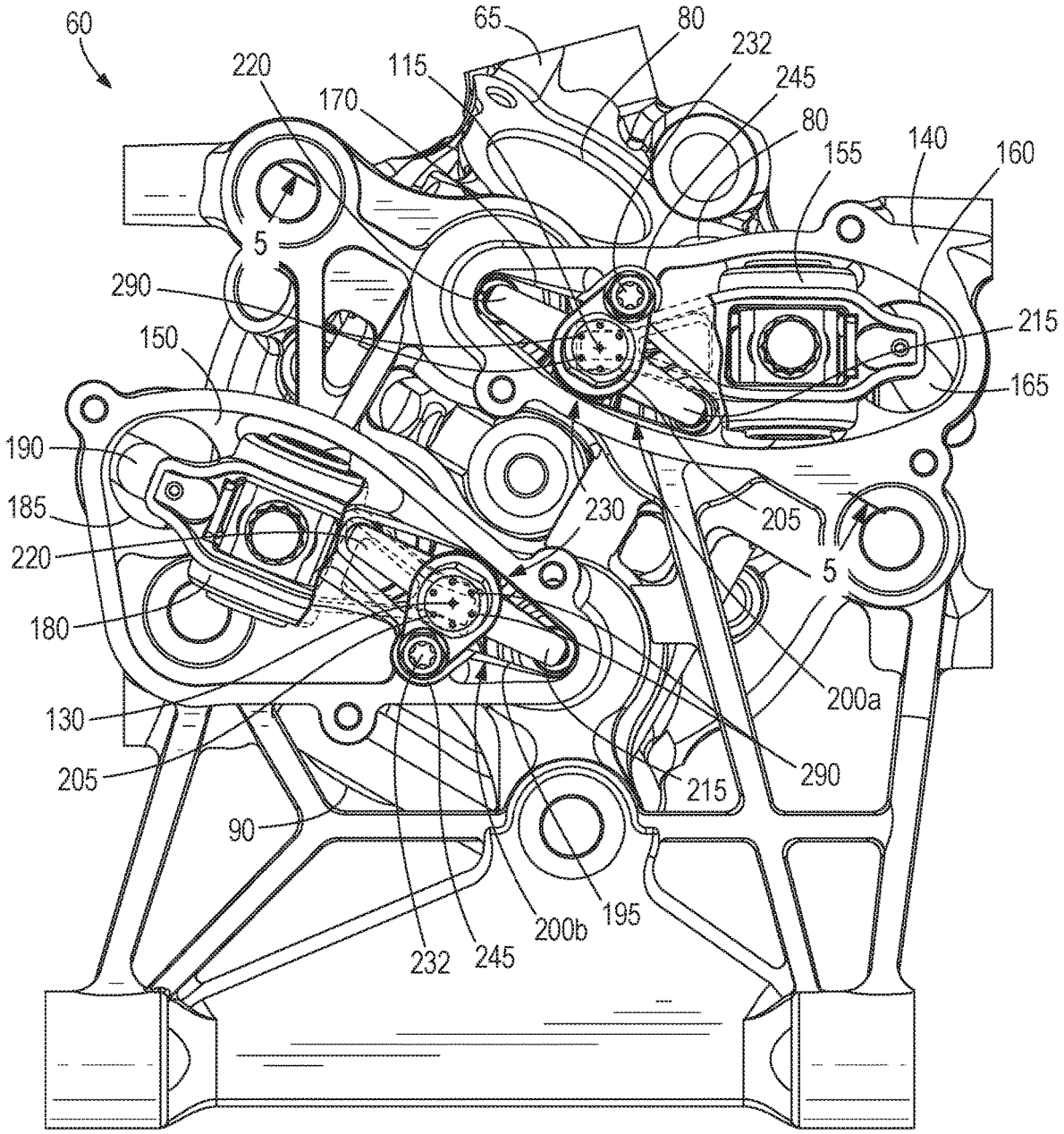
FIG. 3 is a top view of the cylinder head assembly of FIG. 2.

With reference to FIGS. 2 and 3, the cylinder head assembly 60 also includes another fixed member (e.g., a support frame/support plate 140) fixedly coupled on top of the cylinder head 65. The support plate 140 includes a first mounting protrusion 145 extending from a top surface 150 of the support plate 140 in which a first or intake rocker arm 155 is coupled thereto allowing pivotable movement of the intake rocker arm 155 relative to the support plate 140. An intake pushrod aperture 160 is formed through the support plate 140 to receive an intake pushrod 165 that engages the intake rocker arm 155. In addition, an intake valve bridge aperture 170 is formed through the support plate 140 such that the first mounting protrusion 145 is positioned between the intake pushrod aperture 160 and the intake valve bridge aperture 170. The support plate 140 also includes a second mounting protrusion 175 extending from the top surface 150 of the support plate 140 in which a second or exhaust rocker arm 180 is coupled thereto allowing pivotable movement of the exhaust rocker arm 180 relative to the support plate 140. An exhaust pushrod aperture 185 is formed through the support plate 140 to receive an exhaust pushrod 190 that engages the exhaust rocker arm 180. In addition, an exhaust valve bridge aperture 195 is formed through the support plate 140 such that the second mounting protrusion 175 is positioned between the exhaust pushrod aperture 185 and the exhaust valve bridge aperture 195. The illustrated intake and exhaust valve bridge apertures 170, 195 are oblong apertures (e.g., oval shaped apertures; FIG. 3). In other embodiments, the intake and exhaust valve bridge apertures 170, 195 can be a different shape, for example, diamond shaped, rectangular shaped, etc.

Figure 4:
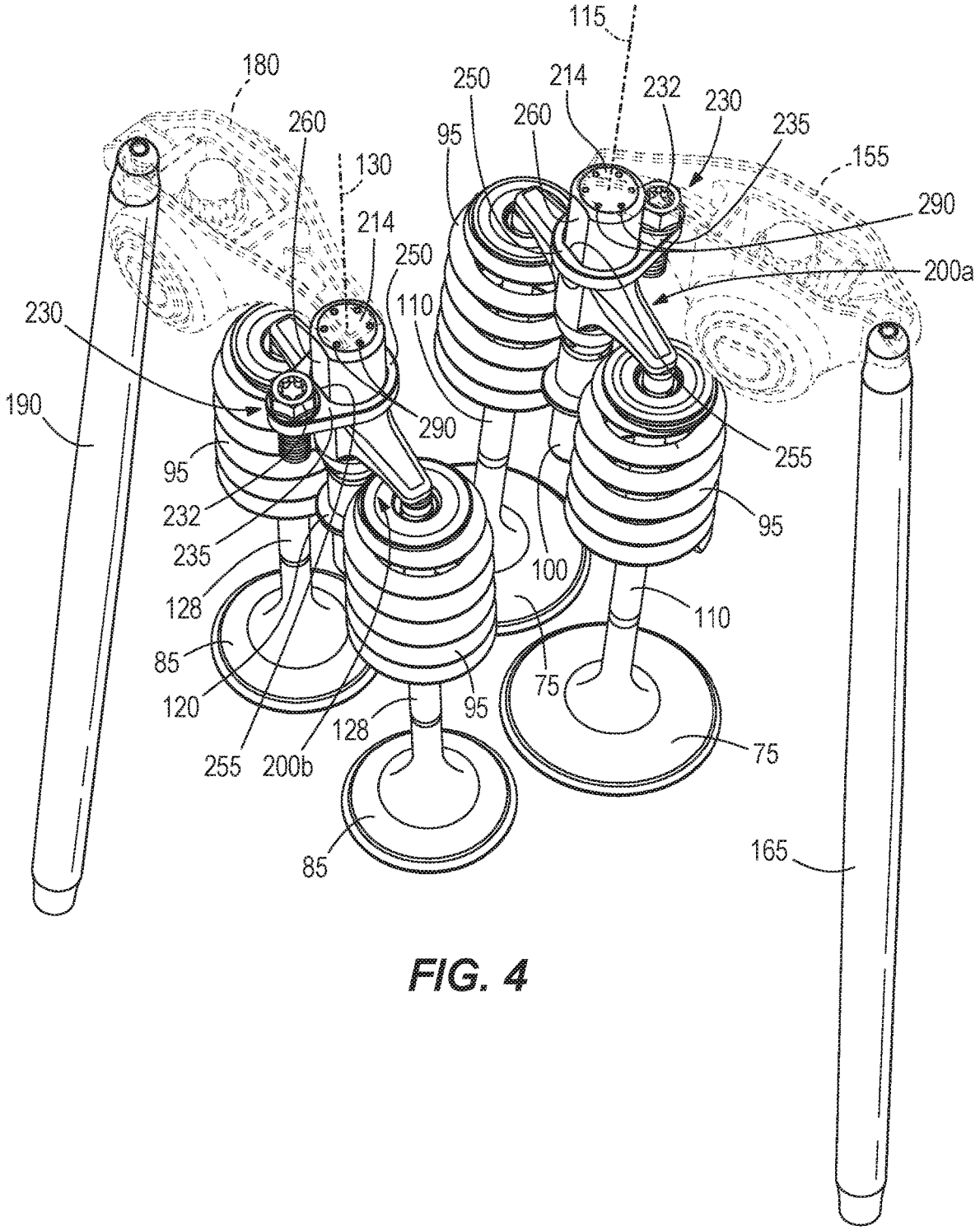
FIG. 4 is a perspective view of a portion of the cylinder head assembly of FIG. 2.

As shown in FIGS. 2-4, the cylinder head assembly 60 further includes two valve bridges **200*a*, 200*b* each having a body 205 coupled to an arm portion 210. The body 205 includes a central cavity 212 (FIG. 5) and a top wall having an end surface 214. The arm portion 210 includes a first arm 215 radially extending outwardly from the body 205 and a second arm 220 positioned opposite the first arm 215 and radially extending outwardly from the body 205. The body 205 and the arm portion 210 are formed as a one-piece integral component in the illustrated embodiment. In other embodiments, the body 205 can be formed as a separate component from the first and second arms 215, 220**.

During assembly of the cylinder head assembly 60, the support plate 140 is secured to the cylinder head 65 by fasteners after the valves 75, 85, the valve springs 95, and the fixed posts 100, 120 are coupled to the cylinder head 65. Thereafter, the first valve bridge **200*a* is inserted downwardly through the intake valve bridge aperture 170 such that the first fixed post 100 is received within the central cavity 212 (FIG. 5) of the first valve bridge 200*a*. In other words, the intake valve bridge aperture 170 is sized to allow the arm portion 210 and a portion of the body 205 to pass through the intake valve bridge aperture 170 after the support plate 140 is secured to the cylinder head 65. Once the first valve bridge 200*a* is received on the first fixed post 100, the body 205 is constrained to be coaxial with the first longitudinal axis 115 of the first fixed post 100 (FIG. 5). In addition, the first and second arms 215, 220 of the first valve bridge 200*a* each engage an end of the valve stems 110 of the intake valve 75**.

An anti-rotation feature 230 is positioned between the first valve bridge **200*a* and the support plate 140 to inhibit substantial rotation (e.g., less than 20 degrees, less than 10 degrees, etc.) of the first valve bridge 200*a* about the first longitudinal axis 115 (e.g., restrict movement of the first valve bridge 200*a* to maintain the engagement between the intake valves 75 and the arm portion 210). In other words, the anti-rotation feature 230 restricts the first valve bridge 200*a* to one degree of freedom (i.e., axial movement along the first longitudinal axis 115). The anti-rotation feature 230 includes a bracket 235 secured to the support plate 140 by a fastener 232**. In the illustrated embodiment, the bracket 235 is a non-metallic bracket (e.g., a nylon bracket, etc.), however, in other embodiments, the bracket 235 can be a metallic bracket (e.g., an aluminum bracket, etc.). A portion of the bracket 235 is received within a recess 245 formed in the support plate 140 adjacent the intake valve bridge aperture 170 (FIG. 3). The recess 245 helps limit movement of the bracket 235 about the fastener (e.g., inhibit pivotable movement of the bracket 235 relative to the support plate 140), as well as, locates the bracket 235 relative to the support plate 140 such that the valve bridge 200*a* engages the intake valves 75. With reference to FIG. 4, each bracket 235 includes a ring portion 250 having two internal flat surfaces 255 (e.g., two opposing flats) that interface with two external flat surfaces 260 of the body 205 to restrict rotation of the first valve bridge 200*a* relative to the bracket 235. In other embodiments, the ring portion 250 can include one internal flat surface 255, and the body 205 can include one external flat surface 260. In further embodiments, the interface between the ring portion 250 and the body 205 can be different, for example, a hexagonal shape/interface, non-circular shape/interface, etc. Furthermore, the intake rocker arm 155 is coupled to the first mounting protrusion 145 such that a finger 265 of the intake rocker arm 155 engages the end surface 214 of the body 205 during assembly of the cylinder head assembly 60. In other embodiments, the cylinder head assembly 60 can be assembled in a process not explicitly disclosed herein.

A similar assembly process is associated with the second valve bridge 200*b* as is described above directed to the first valve bridge 200*a*. For example, the second valve bridge 200*b* is inserted downwardly through the exhaust valve bridge aperture 195 such that the second fixed post 120 is received within the central cavity 212 of the second valve bridge 200*b*, the first arm 215 engages an end of the valve stem 128 of one exhaust valve 85, and the second arm 220 engages an end of the valve stem 128 of the other exhaust valve 85. Once the second valve bridge 200*b* is received on the second fixed post 120, the body 205 is constrained to be coaxial with the second longitudinal axis 130 of the second fixed post 120. A second anti-rotation feature 230 is positioned between the second valve bridge 200*b* and the support plate 140 to restrict movement of the second valve bridge 200*b* to one degree of freedom (i.e., axial movement along the second longitudinal axis 130). The exhaust rocker arm 180 is coupled to the second mounting protrusion 175 such that a finger 270 of the exhaust rocker arm 180 engages the end surface 214 of the second valve bridge 200*b*.

In operation of the engine 40, the intake rocker arm 155 is pivotable by the intake pushrod 165 for the finger 265 of the intake rocker arm 155 to push the first valve bridge 200*a* axially downwardly along the first longitudinal axis 115 (toward the combustion chamber 70) against the biasing force of the valve springs 95 associated with the intake valves 75. Simultaneously, the arm portion 210 of the first valve bridge 200*a* moves the intake valves 75 from the closed position (FIG. 5) into an open position (FIG. 6) allowing air—in some embodiments, a mixture of air and fuel—into the combustion chamber 70. The intake rocker arm 155 then pivots in an opposite direction for the valve springs 95 to push the first valve bridge 200*a* upwardly allowing the intake valves 75 to move back into the closed position. The fuel within the combustion chamber 70 is then ignited. To allow the exhaust gases from the ignited fuel to escape from the combustion chamber 70, the exhaust rocker arm 180 pivots by the exhaust pushrod 190 for the finger 270 of the exhaust rocker arm 180 to push the second valve bridge 200*b* axially downwardly along the second longitudinal axis 130 against the biasing force of the valve springs 95 associated with the exhaust valves 85. Simultaneously, the arm portion 210 of the second valve bridge 200*b* moves the exhaust valves 85 from a closed position (similar to what is shown FIG. 5) into an open position (similar to what is shown in FIG. 6) to allow the exhaust gases to escape from the combustion chamber 70. The exhaust rocker arm 180 then pivots in an opposite direction for the valve springs 95 to push the second valve bridge 200*b* upwardly allowing the exhaust valves 85 to move back into the closed position. This process repeats to ultimately supply power to the rear wheel 35 to move the motorcycle 10.

Furthermore, the first and second fixed posts 100, 120 supply portions of the cylinder head assembly 60 with lubricant. Operation of such lubricant supply will be discussed in respect to the first fixed post 100 as shown in FIGS. 5 and 6, but a similar operation is equally applicable to the second fixed post 120. The passageway 135 of the first fixed post 100 includes a first outlet 275 and a second outlet 280 with each outlet 275, 280 defining a projection line 282 oriented upwardly away from the cylinder head 65. For example, an oblique angle θ (FIG. 5) extending between the first longitudinal axis 115 and each projection line 282 is between 1 degree and 89 degrees. In other embodiments, the angle θ is between about 10 degrees and about 40 degrees. In further embodiments, the passageway 135 can include one outlet, three outlets, four outlets, etc. As the engine 40 operates (as discussed above), lubricant is pumped through the passageway 135 to be dispensed from the first and second outlets 275, 280. While the intake valves 75 are in the closed position (FIG. 5), the lubricant is dispensed from the outlets 275, 280 with enough force to contact a bottom surface 285 (defining a U-shaped channel) of the arm portion 210 for the lubricant to be redirected on top of the intake valves 75 and the associated valve springs 95. In other words, the projection lines 282 intersect the bottom surface 285 of the arm portion 210. As the intake valves 75 transition from the closed position (FIG. 5) to the open position (FIG. 6), the first valve bridge 200*a* moves relative to the first fixed post 100 to position the outlets 275, 280 within the cavity 212 of the body 205. As a result, lubricant is also dispensed into the cavity 212 between the body 205 and the first fixed post 100 to reduce the coefficient of friction therebetween. In addition, the post 100 includes an open end received within the cavity 212 such that the open end is in fluid communication with the wall defining the end surface 214. Although not shown, a restrictor valve is located within the open end to limit the amount of lubricant that enters the cavity 212. As the intake valves 75 transition from the closed position to the open position, air and/or lubricant that is located within the cavity 212 can escape through a plurality of holes 290 formed in the body 205 (through the wall defining the end surface 214). As such, movement of the first valve bridge 200*a* along the first longitudinal axis 115 is not restricted by pressure increasing in the cavity 212 or by a vacuum forming in the cavity 212. The lubricant escaping through the holes 290 can also lubricate the engagement between the end surface 214 and the intake rocker arm 155. In addition, the cylindrical first fixed post 100 includes at least one truncated surface 295 (FIG. 2) formed on its perimeter to provide a gap between the post 100 and an inner curved wall of the cavity 212 to allow for lubricant to escape the cavity 212 in a downward direction toward the cylinder head 65.

The disclosed arrangement of the valve bridges 200*a*, 200*b* can significantly improve the valve-to-valve imbalance present in known bridge-type valve trains where two similar valves are actuated by a rocker arm through a valve bridge.

In the illustrated embodiment, the first valve bridge 200*a* simultaneously actuates the two intake valves 75 between the open and closed positions for the intake stroke of the engine 40. Likewise, the second valve bridge 200*b* simultaneously actuates the two exhaust valves 85 between the open and closed positions for the exhaust stroke of the engine 40. Because the valve bridges 200*a*, 200*b* are restricted to one degree of freedom, pivotable movement of the rocker arms 155, 180 is not transferred to the valve bridges 200*a*, 200*b*, which could cause relative movement between the two intake valves 75 or relative movement between the two exhaust valves 85. Such relative movement of the pair of common valves 75, 85 could decrease performance of the engine 40. However, the improved valve-to-valve actuation uniformity as disclosed in the illustrated embodiment can enable higher engine operating speeds and performance potential than known bridge-type valve trains. For example, the illustrated embodiment can reach a maximum engine operating speed between about 6,800 revolutions per minute (RPM) and about 7,000 RPM, whereas known bridge-type valve trains can only reach a maximum engine operating speed of about 4,000.

Furthermore, maintenance/replacement of the valve bridges 200*a*, 200*b* can be easily accomplished by removing the respective rocker arms 155, 180 and anti-rotation feature 230 without removing the support plate 140. For example, the valve bridges 200*a*, 200*b* are removable through the respective valve bridge aperture 170, 195 without removing the support plate 140 from the cylinder head 65.

FIGS. 7-12 illustrate a cylinder head assembly 360 according to another embodiment. The cylinder head assembly 360 is similar to the cylinder head assembly 60; therefore, similar components are designated with similar references numbers each incremented by 300. At least some differences and/or at least some similarities between the cylinder head assemblies 60, 360 will be discussed in detail below. In addition, components or features described with respect to only one or some of the embodiments described herein are equally applicable to any other embodiments described herein.

The cylinder head assembly 360 includes substantially the same cylinder head 65, intake valves 75, exhaust valves 85, valve springs 95, intake rocker arm 155, exhaust rocker arm 180, intake pushrod 165, exhaust pushrod 190, etc. as discussed above. However, a support plate 440 of the cylinder head assembly 360 includes cylindrical walls 610 extending from a top surface 450 of the plate 440 with each wall 610 surrounding one of an intake valve bridge aperture 470 and an exhaust valve bridge aperture 495. In this embodiment, the apertures 470, 495 are substantially circular apertures.

Figure 7:
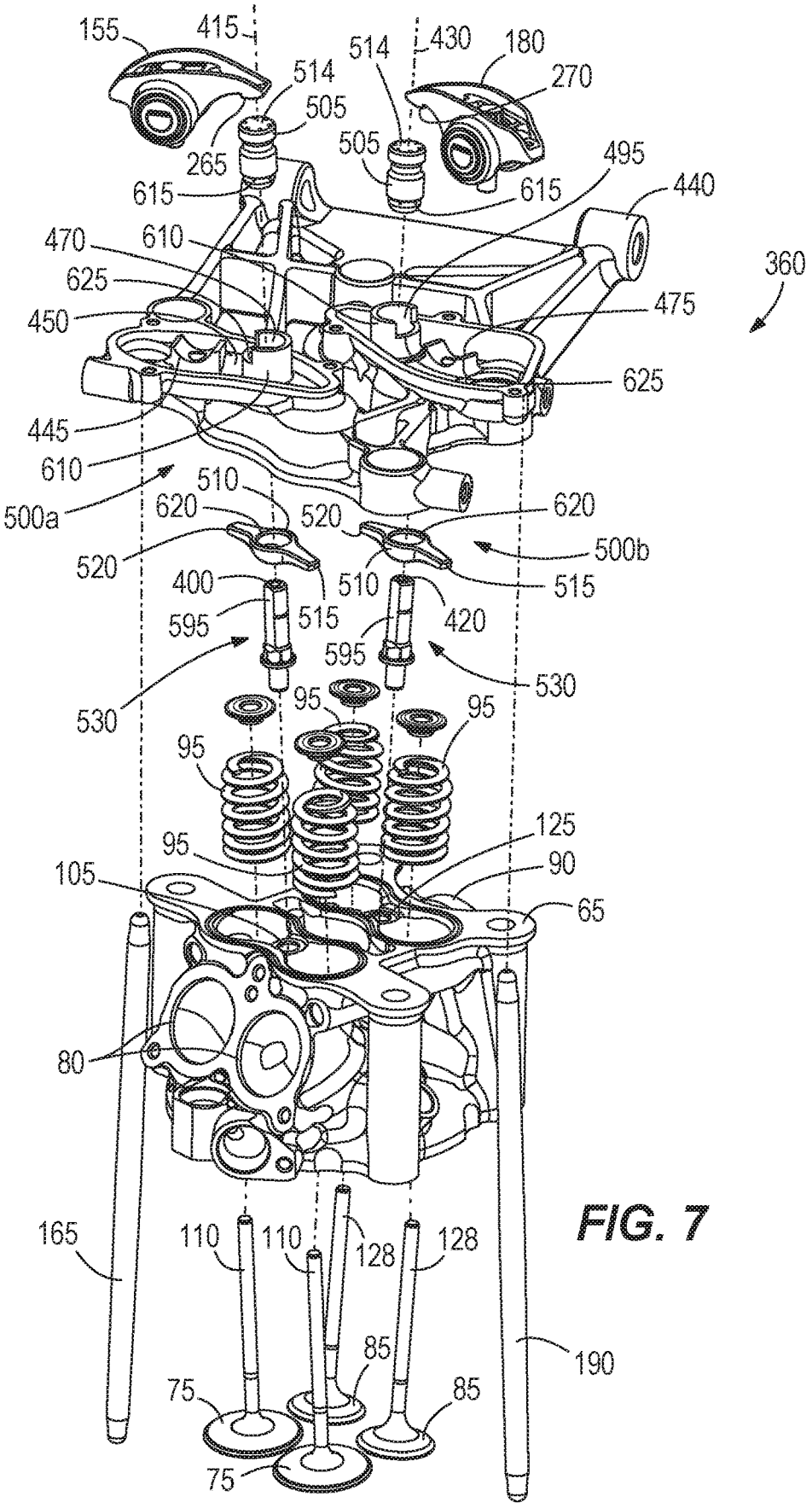
FIG. 7 is an exploded view of a cylinder head assembly according to another embodiment.
Figure 8:
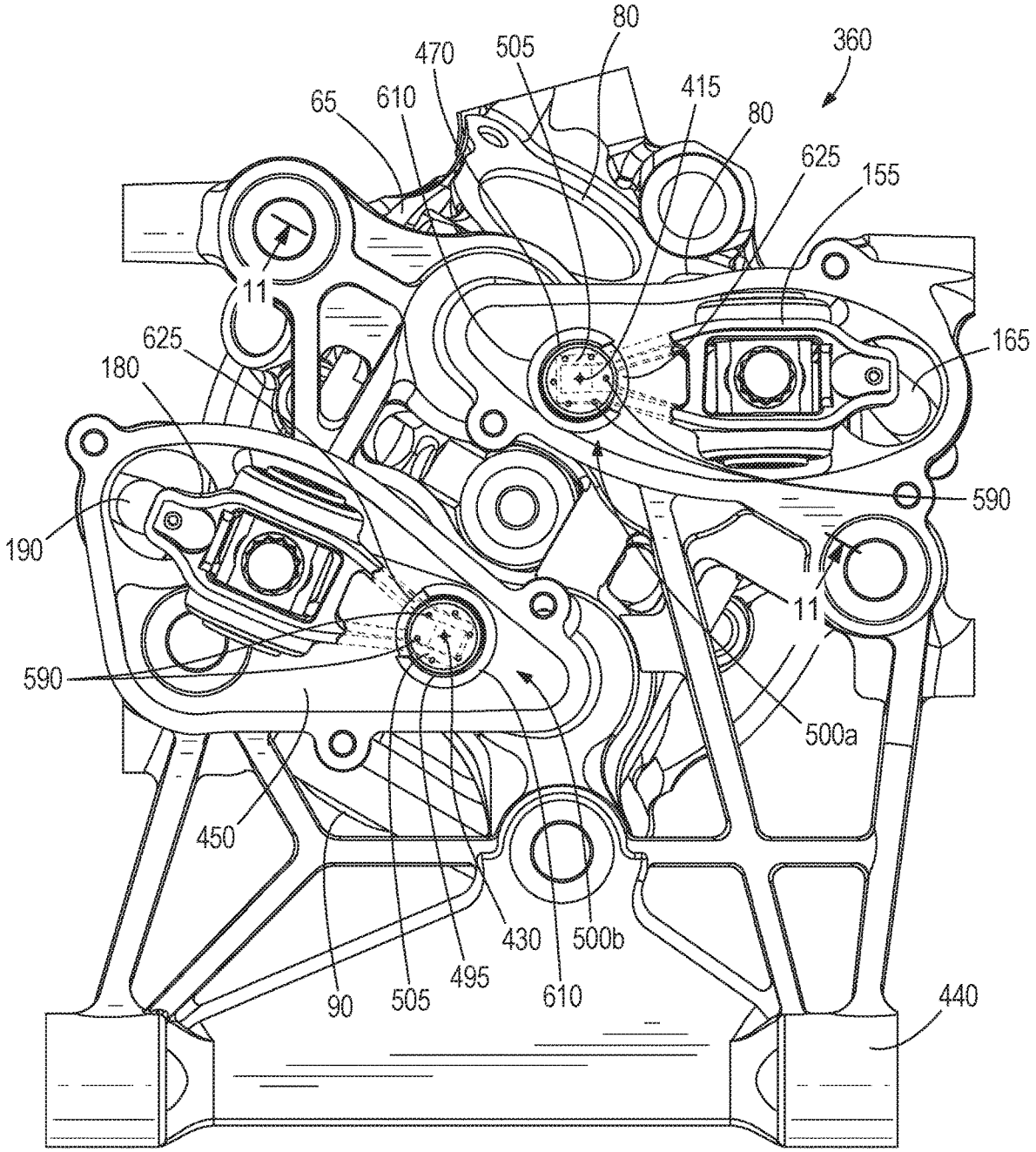
FIG. 8 is a top view of the cylinder head assembly of FIG. 7.
Figure 9:
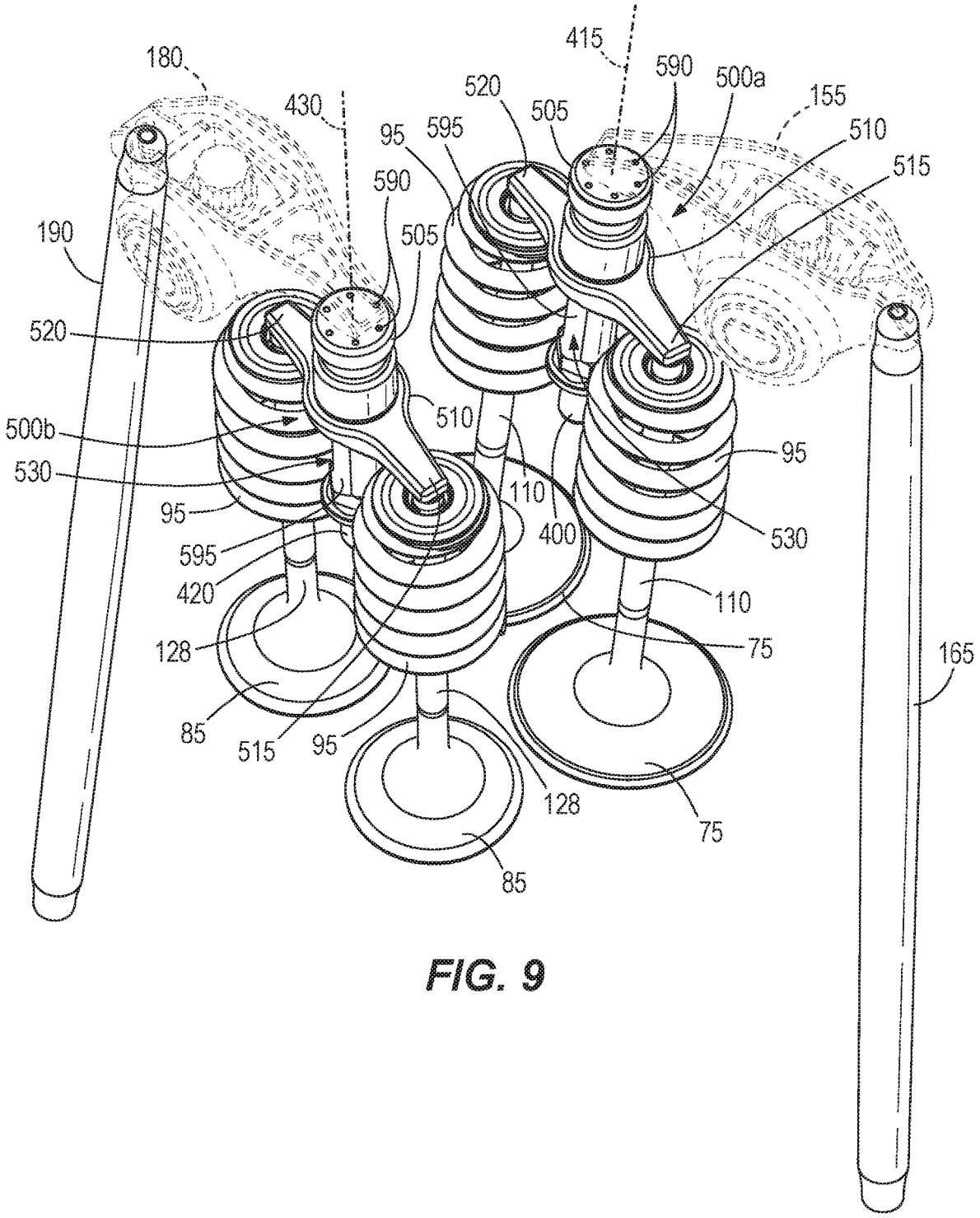
FIG. 9 is a perspective view of a portion of the cylinder head assembly of FIG. 7.
Figure 10:
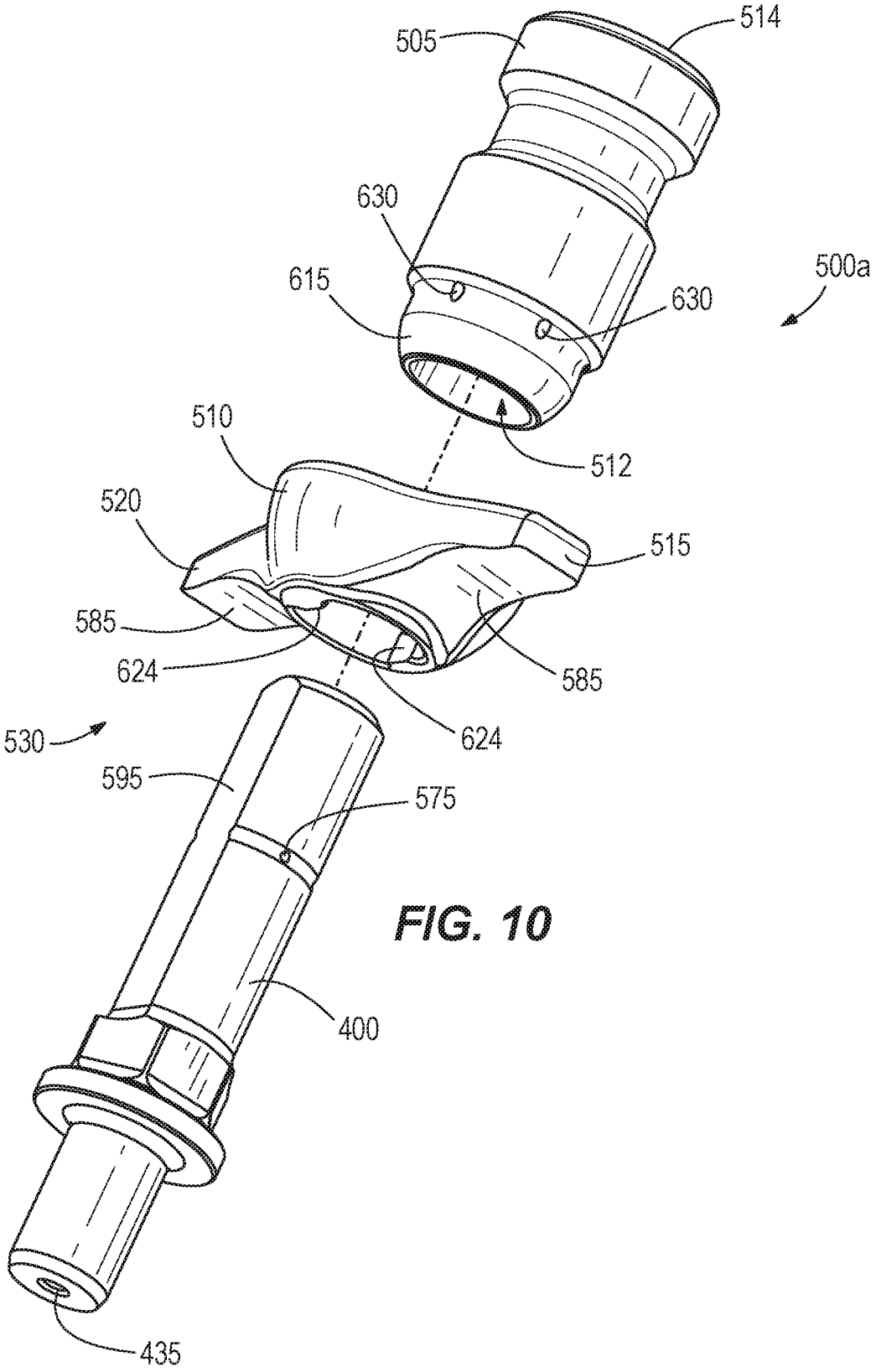
FIG. 10 is an exploded view of a portion of the cylinder head assembly of FIG. 9.

As shown in FIGS. 7, 9, and 10, the cylinder head assembly 360 further includes two valve bridges 500*a*, 500*b* each having a body 505 coupled to an arm portion 510 with a first arm 515 and a second arm 520. In particular, the body 505 includes a bottom curved surface 615 (e.g., forming part of a sphere) that is received within a complementary recess 620 of the arm portion 510 (e.g., the body 505 and the arm portion 510 are coupled together by a ball-and-socket joint). The ball-and-socket joint enables the arm portion 510 to pivot relative to the body 505. In other embodiments, the body 505 can include the recess 620 and the arm portion 510 can include the curved surface 615.

Figure 11:
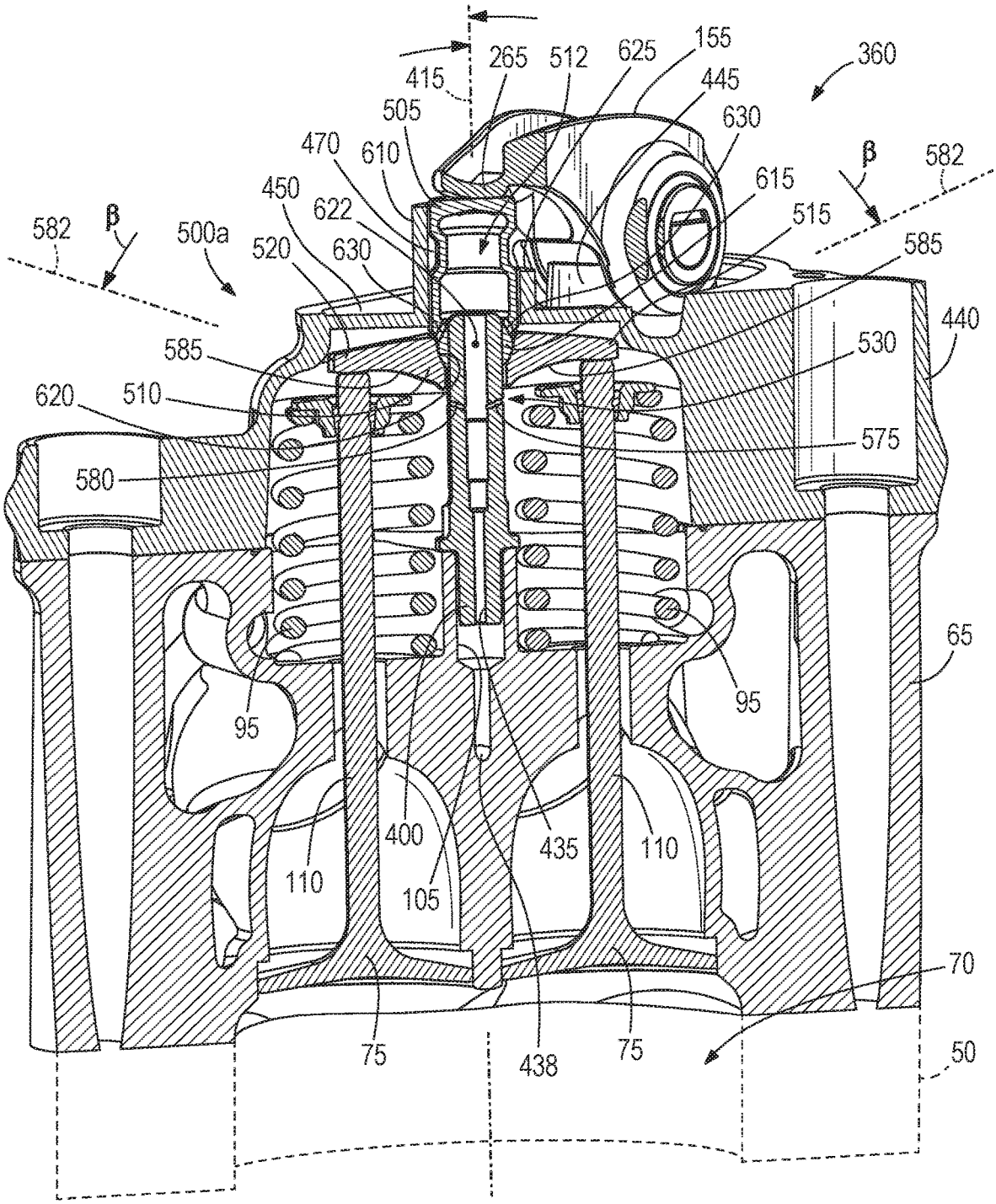
FIG. 11 is a cross sectional view of the cylinder head assembly taken along line 11-11 of FIG. 8 illustrating the valves of the cylinder head assembly in the closed position.
Figure 12:
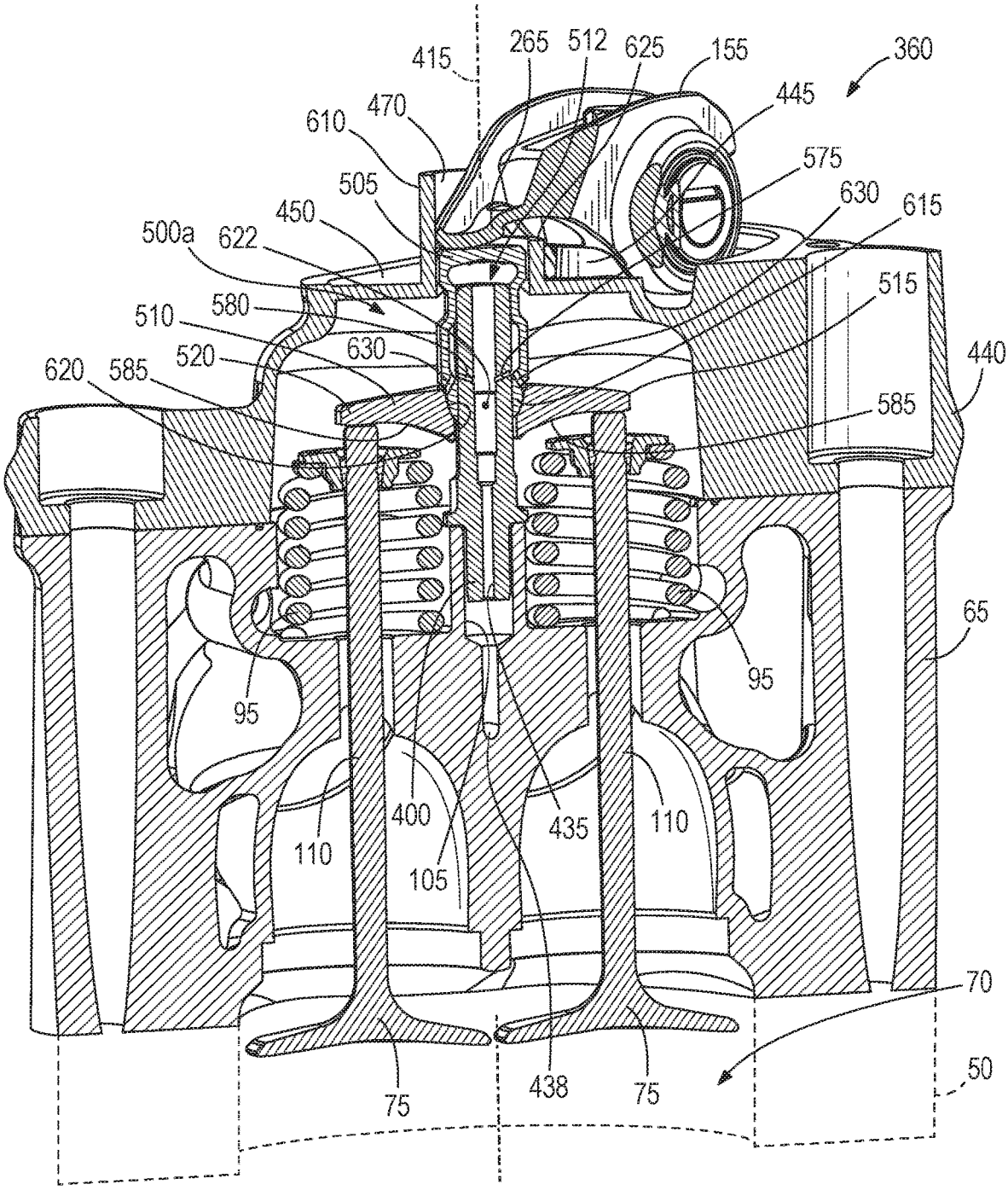
FIG. 12 is a cross sectional view of the cylinder head assembly taken along line 11-11 of FIG. 8 illustrating the valves of the cylinder head assembly in the open position.

During assembly of the cylinder head assembly 360, a first fixed post 400 is secured to the cylinder head 65 and the arm portion 510 of the first valve bridge 500*a* is received on the first fixed post 400 for the first fixed post 400 to extend through the recess 620 of the arm portion 510. Moreover, the arm portion 510 includes at least one non-circular surface 624 (two flat surfaces 624 are illustrated in FIG. 10) that interfaces with a complementary non-circular surface 595 (e.g., a flat surface) of the first fixed post 400 to restrict the arm portion 510 from rotating about a first longitudinal axis 415 of the first fixed post 400. Such an interface between the arm portion 510 and the first fixed post 400 is an anti-rotation feature 530 to maintain engagement between the intake valves 75 and the arms 515, 520. In addition, the anti-rotation feature 530 and the ball-and-socket joint of the first valve bridge 500*a* allows the arm portion 510 to pivot about a point 622 on the first longitudinal axis 415 (FIGS. 11 and 12).

A similar process occurs to couple the arm portion 510 of second valve bridge 500*b* to a second fixed post 420 such that the arms 515, 520 of the second valve bridge 500*b* maintain engagement with the exhaust valves 85 and restricts movement of the arm portion 510 about a second longitudinal axis 430 of the second fixed post 420. In addition, the anti-rotation feature 530 and the ball-and-socket joint of the second valve bridge 500*b* allows the arm portion 510 to pivot about the point 622 on the second longitudinal axis 430 (similar to what is shown in FIGS. 11 and 12).

After the bridges 510 of the valve bridges 500*a*, 500*b* are installed onto their respective fixed posts 400, 420, the support plate 440 is secured to the cylinder head 65. The body 505 of the first valve bridge 500*a* is inserted into one of the cylindrical walls 610 to engage its arm portion 510, and the body 505 of the second valve bridge 500*b* is inserted into the other cylindrical wall 610 to engage its arm portion 510. In other embodiments, the body 505 of the first and second valve bridges 500*a*, 500*b* can be installed before the support plate 440 is secured to the cylinder head 65.

The intake rocker arm 155 is coupled to a first mounting protrusion 445 of the support plate 440 for the finger 265 of the intake rocker arm 155 to engage an end surface 514 of the first valve bridge 500*a*. Likewise, the exhaust rocker arm 180 is coupled to a second mounting protrusion 475 such that the finger 270 of the exhaust rocker arm 180 engages the end surface 514 of the second valve bridge 500*b*.

Operation of the engine 40 including the cylinder head assembly 360 is substantially the same as operation of the engine 40 including the cylinder head assembly 60. However, due to the ball-and-socket joint of the valve bridges 500*a*, 500*b*, the arm portion 510 of the valve bridges 500*a*, 500*b* can move in two degrees of freedom. First, the arm portion 510—in addition to the body 505—of each valve bridge 500*a*, 500*b* is axially moveable along the corresponding first and second longitudinal axis 415, 430. The axial movement is guided by the respective fixed posts 400, 420 being received within a cavity 512 of the corresponding valve bridge 500*a*, 500*b*, as well as, the body 505 of each valve bridge 500*a*, 500*b* received within the corresponding wall 610 of the support plate 440. As such, the walls 610 inhibit the pivoting movement of the rocker arms 155, 180 to be transferred to the valve bridges 500*a*, 500*b*. Second, the arm portion 510 can pivot relative to the body 505 of the valve bridges 500*a*, 500*b* via the ball-and-socket joint about the point 622 to account for different lengths of the intake and exhaust valves 75, 85 (e.g., due to manufacturing tolerances) and/or different spring rates of the valve springs 95. The pivoting movement of the arm portion 510 relative to the body 505 during installation and/or operation of the engine 40 seeks to provide actuation balance to the intake and exhaust valves 75, 85.

In addition, each wall 610 of the support plate 440 includes a notch or opening 625 sized to receive the finger 265, 270 of the corresponding intake and exhaust rocker arm 155, 180. As such, enough clearance between each wall 610 and the respective intake and exhaust rocker arms 155, 180 is provided for the intake and exhaust rocker arms 155, 180 to move the valves 75, 85 between the open and closed positions.

Furthermore, the first and second fixed posts 400, 420 supply portions of the cylinder head assembly 360 with lubricant from an oil gallery 438. Operation of such lubricant supply will be discussed in respect to the first fixed post 400 as shown in FIGS. 11 and 12, but a similar operation is equally applicable to the second fixed post 420. First and second outlets 575, 580 of a passageway 435 of the first fixed post 400 direct lubricant to a bottom surface 585 of the arm portion 510 while the intake valves 75 are in the closed position (FIG. 11). For example, a projection line 582 defined by each outlet 575, 580 intersects the bottom surface 585 of the arm portion 510 with each projection line 582 oriented at an upwardly oblique angle θ relative to the longitudinal axis 415. The passageway 435 also directs lubricant into the cavity 512 of the first valve bridge 500*a* as the intake valves 75 transition to the open position (FIG. 12). The body 505 includes a plurality of holes 590 (FIG. 9) extending through the top end surface 514 of the first valve bridge 500*a* to allow for air and/or lubricant to escape from the cavity 512. In addition, a bottom portion of the body 505 also includes a plurality of holes 630 (FIG. 10) adjacent the curved surface 615 to allow for the lubricant to move downwardly into the interface between the arm portion 510 and the body 505.

Although the disclosure has been described in detail with reference to certain preferred embodiments, variations and modifications exist within the scope and spirit of one or more independent aspects of the disclosure as described. Various features and advantages of the disclosure are set forth in the following claims.

The invention claimed is:

1. A cylinder head assembly for an internal combustion engine, the cylinder head assembly comprising:
- a cylinder head;
- first and second valves coupled to the cylinder head, the first and second valves associated with a combustion chamber partially defined by the cylinder head;
- a fixed member coupled to the cylinder head;
- a valve bridge engaging the first and second valves, the valve bridge configured to axially move along an axis relative to the fixed member to move the first and second valves together between an open position and a closed position; and
- an anti-rotation feature between the valve bridge and the fixed member such that a portion of the anti-rotation feature engages the fixed member, the anti-rotation feature restricting rotational movement of the valve bridge about the axis.

2. The cylinder head assembly of claim 1, wherein the fixed member is a support frame pivotably supporting a rocker arm that engages a body of the valve bridge, and wherein the anti-rotation feature includes a bracket selectively coupled to the support frame and the body of the valve bridge.

3. The cylinder head assembly of claim 2, wherein the bracket includes a ring portion having a non-circular inner surface that interfaces with an outer surface of the body.

4. The cylinder head assembly of claim 1, wherein the fixed member includes a post received within the valve bridge such that the post guides the valve bridge axially along the axis, and wherein the anti-rotation feature includes a non-circular inner surface of the valve bridge that interfaces with an outer surface of the post.

5. The cylinder head assembly of claim 4, wherein the valve bridge includes a body coupled to an arm portion by a ball-and-socket joint, and wherein the arm portion engages the first and second valves and the body engages a rocker arm.

6. The cylinder head assembly of claim 4, wherein the post includes a passageway configured to have a lubricant that is dispensed from an outlet of the post to lubricate an interface of the post and the valve bridge.

7. A cylinder head assembly for an internal combustion engine, the cylinder head assembly comprising:
- a cylinder head;
- first and second valves coupled to the cylinder head, the first and second valves associated with a combustion chamber partially defined by the cylinder head;
- a fixed member coupled to the cylinder head; and
- a valve bridge including
  - a first arm engaging the first valve, and
  - a second arm engaging the second valve,
- wherein the valve bridge is receivable configured to be received through an aperture of the fixed member from above the fixed member for the first and second arms to engage the first and second valves while the fixed member is coupled to the cylinder head.

8. The cylinder head assembly of claim 7, wherein the fixed member is a support frame pivotably supporting a rocker arm that engages a body of the valve bridge for the first and second arms to move the first and second valves in response to pivoting movement of the rocker arm.

9. The cylinder head assembly of claim 8, wherein the body, the first arm, and the second arm of the valve bridge are integrally formed as one component.

10. The cylinder head assembly of claim 8, further comprising a post fixedly coupled to the cylinder head to be slidably received within the valve bridge such that the valve bridge is configured to move along an axis relative to the post and the support frame.

11. The cylinder head assembly of claim 10, wherein the post includes a passageway configured to dispense a lubricant out of the post to lubricate an interface of the post and the valve bridge.

12. The cylinder head assembly of claim 10, further comprising an anti-rotation feature coupled to the body of the valve bridge and the support frame, wherein the anti-rotation feature restricts rotational movement of the valve bridge about the axis.

13. A cylinder head assembly for an internal combustion engine, the cylinder head assembly comprising:
- a cylinder head;
- first and second valves coupled to the cylinder head, the first and second valves associated with a combustion chamber partially defined by the cylinder head;
- a fixed member coupled to the cylinder head, the fixed member including a wall defining an aperture; and
- a valve bridge including
  - a body received within the aperture of the fixed member,
  - a first arm engaging the first valve, and
  - a second arm engaging the second valve,
- wherein the body slidably engages the wall of the fixed member such that the valve bridge is configured to move along an axis relative to the fixed member for the first and second arms to move the first and second valves.

14. The cylinder head assembly of claim 13, wherein the first and second arms of the valve bridge are integrally formed as one component, and wherein the body is coupled to the first and second arms by a ball-and-socket joint such that the first and second arms are configured to move relative to the body.

15. The cylinder head assembly of claim 13, wherein the fixed member is a support frame pivotably supporting a rocker arm that engages the body of the valve bridge.

16. The cylinder head assembly of claim 15, wherein the wall of the fixed member includes an opening sized to receive a finger of the rocker arm, and wherein the finger of the rocker arm engages the body.

17. The cylinder head assembly of claim 13, wherein the fixed member is a support frame, and wherein a post is coupled to the cylinder head to be slidably received within the body to guide the valve bridge along the axis.

18. The cylinder head assembly of claim 17, further comprising an anti-rotation feature positioned between the post and the valve bridge, wherein the anti-rotation feature restricts rotational movement of the first and second arms about the axis.

19. The cylinder head assembly of claim 17, wherein the post includes a passageway configured to dispense a lubricant out of the post to lubricate an interface of the post and the valve bridge.

20. The cylinder head assembly of claim 19, wherein the passageway includes an outlet that is spaced from the body of the valve bridge while the first and second valves are in a closed position, and wherein the outlet is positioned within the body of the valve bridge while the first and second valves are in an open position such that the outlet is configured to dispense the lubricant within the valve bridge.

* * * * *